US009588468B2

(12) United States Patent
Sawamura et al.

(10) Patent No.: US 9,588,468 B2
(45) Date of Patent: Mar. 7, 2017

(54) IMAGE FORMING APPARATUS AND FIXING DEVICE WITH MOVABLE MEMBER

(71) Applicant: FUJI XEROX CO., LTD., Tokyo (JP)

(72) Inventors: Jun Sawamura, Kanagawa (JP); Takayuki Ukawa, Kanagawa (JP); Hideki Sato, Kanagawa (JP); Yoshiro Konishi, Kanagawa (JP); Yasuhiro Kato, Kanagawa (JP); Masahiro Akatsuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/052,104

(22) Filed: Feb. 24, 2016

(65) Prior Publication Data

US 2017/0031281 A1 Feb. 2, 2017

(30) Foreign Application Priority Data

Jul. 27, 2015 (JP) ..... 2015-147340

(51) Int. Cl.
*G03G 15/20* (2006.01)

(52) U.S. Cl.
CPC ..... *G03G 15/2053* (2013.01)

(58) Field of Classification Search
CPC ..... G03G 21/1647; G03G 15/2053; G03G 15/1615; G03G 15/1675; G03G 15/2028; G03G 15/2089
USPC ..... 399/122
See application file for complete search history.

(56) References Cited

U.S. PATENT DOCUMENTS

| | | | | |
|---|---|---|---|---|
| 6,684,050 | B2 * | 1/2004 | Kiuchi | G03G 15/2028 219/216 |
| 9,285,738 | B1 * | 3/2016 | Ukawa | G03G 15/2017 |
| 2012/0148304 | A1 * | 6/2012 | Sugaya | G03G 15/2053 399/122 |
| 2014/0064788 | A1 * | 3/2014 | Mogi | G03G 15/2053 399/122 |
| 2014/0140727 | A1 * | 5/2014 | Shimoi | G03G 21/1633 399/121 |

FOREIGN PATENT DOCUMENTS

JP 2015-007813 1/2015

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

An apparatus includes: an image forming portion that forms an image on a medium; a fixing device removably mounted to an apparatus body to fix the image to the medium, the fixing device including a first rotator that contacts the medium, a second rotator that contacts the first rotator, a movable member movable in first and second directions in which the first and second rotators are moved closer to and away from each other, respectively, an urging member, a first end of which is mounted to the movable member and which urges the movable member in the first direction, and a first support portion that supports a second end of the urging member; a cam member that moves the movable member in the second direction; a shaft member to which the cam member is mounted; and a second support portion that supports the shaft member and the first support portion.

7 Claims, 7 Drawing Sheets

IMAGE FORMING APPARATUS AND FIXING DEVICE WITH MOVABLE MEMBER

CROSS-REFERENCE TO RELATED APPLICATIONS

This application is based on and claims priority under 35 USC 119 from Japanese Patent Application No. 2015-147340 filed Jul. 27, 2015.

BACKGROUND

Technical Field

The present invention relates to an image forming apparatus and a fixing device.

SUMMARY

According to an aspect of the present invention, there is provided an image forming apparatus including: an image forming portion that forms a developer image on a recording medium; and a fixing device that is removably mounted to an image forming apparatus body and that fixes the developer image formed by the image forming portion to the recording medium, in which the fixing device includes a first rotator that contacts the recording medium on which the developer image has been formed by the image forming portion, a second rotator that contacts the first rotator to form an interposition region in which the recording medium is interposed between the first rotator and the second rotator, a movable member that is movable in a direction in which at least one of the first rotator and the second rotator is moved such that a distance between the first rotator and the second rotator becomes shorter and a direction in which at least one of the first rotator and the second rotator is moved such that the distance between the first rotator and the second rotator becomes longer, an urging member, a first end portion side of which is mounted to the movable member, the urging member urging the movable member to move the movable member in the direction in which the first rotator and the second rotator are moved closer to each other, and a first support portion that supports a second end portion side of the urging member, and the image forming apparatus further includes a cam member that moves the movable member in the direction in which the first rotator and the second rotator are moved away from each other against the urging by the urging member, a shaft member to which the cam member is mounted, and a second support portion that supports the shaft member and the first support portion.

BRIEF DESCRIPTION OF THE DRAWINGS

An exemplary embodiment of the present invention will be described in detail based on the following figures, wherein.

DETAILED DESCRIPTION

Figure 1:
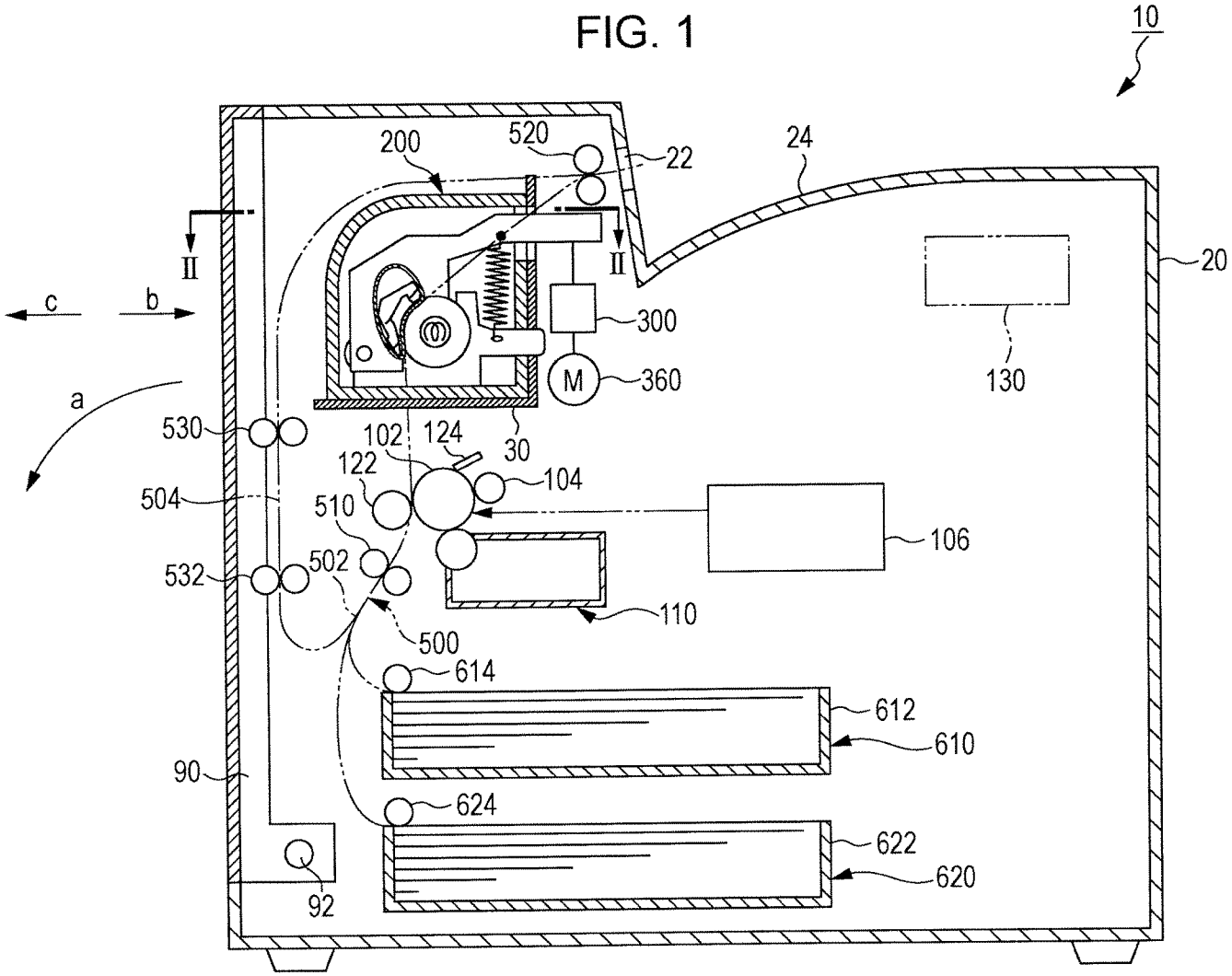
FIG. 1 illustrates a schematic configuration of an image forming apparatus according to an exemplary embodiment of the present invention.

Now, an exemplary embodiment of the present invention will be described with reference to the drawings. FIG. 1 illustrates an image forming apparatus 10 according to an exemplary embodiment of the present invention. As illustrated in FIG. 1, the image forming apparatus 10 includes an image forming apparatus body 20. An ejection port 22 that ejects paper used as a recording medium is formed in the image forming apparatus body 20. The upper surface of the image forming apparatus body 20 is used as an ejection portion 24 to which paper to which a developer image has been fixed is ejected.

The image forming apparatus body 20 includes a tie plate 30. The tie plate 30 constitutes a part of the image forming apparatus body 20. The tie plate 30 is used as a second support portion, and used as a fixed portion to which a fixing device 200 to be discussed later is fixed. With the fixing device 200 fixed to the tie plate 30, the fixing device 200 is accurately positioned in the image forming apparatus body 20, and reinforced. The tie plate 30 will be discussed in detail later.

An open/close portion 90 is attached to the left side (left side in FIG. 1) of the image forming apparatus body 20 using a hinge 92. The open/close portion 90 is openable and closable with respect to the image forming apparatus body 20 by rotating the open/close portion 90 about the hinge 92. FIG. 1 illustrates a state in which the open/close portion 90 is closed with respect to the image forming apparatus body 20. The open/close portion 90 is opened with respect to the image forming apparatus body 20 by rotating the open/close portion 90 about the hinge 92 in the direction of the arrow a indicated in FIG. 1 from the state illustrated in FIG. 1.

An image forming portion 100 that forms a developer image on paper is disposed in the image forming apparatus body 20. The image forming portion 100 includes a photosensitive drum 102, a charging device 104, a latent image forming device 106, a developing device 110, a transfer device 122, and a cleaning device 124. The photosensitive drum 102 is used as an image holding element that holds an image. The charging device 104 uniformly charges a surface of the photosensitive drum 102. The latent image forming device 106 forms an electrostatic latent image on the surface of the photosensitive drum 102 uniformly charged by the charging device 104. The developing device 110 develops the latent image formed by the latent image forming device 106 using a developer. The transfer device 122 transfers the developer image, which has been formed on the surface of the photosensitive drum 102 by the developing device 110 developing the latent image, to paper. The cleaning device 124 cleans the developer or the like remaining on the surface of the photosensitive drum 102 after the developer image is transferred to the paper by the transfer device 122.

The fixing device 200 which fixes the developer image formed on the paper by the image forming portion 100 to the paper is disposed in the image forming apparatus body 20. The fixing device 200 is mountable to and removable from the image forming apparatus body 20, and fixed to the tie plate 30 with the fixing device 200 mounted to the image forming apparatus body 20.

To mount the fixing device 200 to the image forming apparatus body 20, the open/close portion 90 is opened with respect to the image forming apparatus body 20, and an operator inserts the fixing device 200 into the image forming apparatus body 20 from the outside of the image forming apparatus body 20 toward the tie plate 30. The arrow b indicated in FIG. 1 indicates the direction in which the fixing device 200 is inserted into the image forming apparatus body 20. To detach the fixing device 200 from the image forming apparatus body 20, the open/close portion 90 is opened with respect to the image forming apparatus body 20, and the fixing device 200 which has been fixed to the tie plate 30 is drawn out of the image forming apparatus body 20. The arrow c indicated in FIG. 1 indicates the direction in which the fixing device 200 drawn out of the image forming apparatus body 20.

The fixing device 200 is mounted to and removed from the image forming apparatus body 20 to replace the fixing device 200 which has been used so far with another fixing device 200, for example, because a fixing roller 204 to be discussed later or a fixing belt 230 to be discussed later has been degraded along with use. The fixing device 200 will be discussed in detail later.

A paper feed device 610 and a paper feed device 620 are disposed in the image forming apparatus body 20. The paper feed device 610 supplies paper such as regular paper and an envelope (hereinafter referred to as "paper etc.") to the image forming portion 100. The paper feed device 620 also supplies paper etc. to the image forming portion 100. The paper feed device 610 includes a paper accommodation portion 612 and a feeding device 614. The paper accommodation portion 612 accommodates paper etc. in a stacked state. The feeding device 614 feeds the paper etc. accommodated in the paper accommodation portion 612 to a transport path 500 to be discussed later. The paper feed device 620 includes a paper accommodation portion 622 and a feeding device 624. The paper accommodation portion 622 accommodates paper etc. in a stacked state. The feeding device 624 feeds the paper etc. accommodated in the paper accommodation portion 622 to the transport path 500 to be discussed later.

The paper accommodation portion 612 and the paper accommodation portion 622 may accommodate paper etc. of different types or sizes. Examples of the paper etc. of different types include paper of different thicknesses. Additional examples of the paper etc. of different types include regular paper and an envelope. To fix the developer to paper of different types such as paper of different thicknesses, it is desirable to employ different fixing conditions under which the fixing device 200 fixes a developer image to the paper.

The transport path 500 for transport of the paper etc. is formed in the image forming apparatus body 20. The transport path 500 includes a principal transport path 502 and a reverse transport path 504. The paper feed device 620 discussed earlier, the paper feed device 610 discussed earlier, a resist roller 510, the transfer device 122 discussed earlier and the photosensitive drum 102 discussed earlier, the fixing device 200 discussed earlier, and an ejection roller 520 are disposed along the principal transport path 502 in this order from the upstream side in the direction of transport of the paper etc. through the principal transport path 502.

The resist roller 510 temporarily stops movement of the distal end portion of the paper etc. supplied from one of the paper feed device 610 and the paper feed device 620, and resumes movement of the distal end portion of the paper etc. to a transfer portion formed by the photosensitive drum 102 and the transfer device 122 so as to match the timing when a toner image is formed on the surface of the photosensitive drum 102.

The transfer device 122 electrostatically transfers the toner image, which has been formed on the surface of the photosensitive drum 102, to the paper etc. using a transfer bias applied to the transfer device 122.

The ejection roller 520 ejects the paper etc., to which the toner image has been fixed by the fixing device 200, toward the ejection portion 24 through the ejection port 22. To form a developer image on the other surface of paper etc., on one surface of which a developer image has been formed, the ejection roller 520 starts rotating in the opposite direction at the timing when a portion near the rear end portion of the paper etc. reaches the ejection roller 520, and the ejection roller 520 rotates in the opposite direction to feed the paper etc., on one surface of which a developer image has been formed, to the reverse transport path 504 from the rear end portion side.

Two transport rollers 530 and 532, for example, are disposed along the reverse transport path 504 in this order from the upstream side in the direction of transport of paper etc. in the reverse transport path 504. The transport roller 530 and the transport roller 532 transport the paper etc., on one surface of which a toner image has been formed, toward the resist roller 510 with the paper turned over.

An operation panel 130 used as an operation portion for operating the image forming apparatus 10 is attached to the front surface, for example, of the image forming apparatus body 20. The operation panel 130 is used by the operator to input information about image formation such as which of the paper feed device 610 and the paper feed device 620 supplies paper, for example.

A change mechanism 300 and a motor 360 are disposed in the image forming apparatus body 20. The change mechanism 300 changes a force with which the fixing roller 204 to be discussed later and the fixing belt 230 to be discussed later are pressed against each other. The motor 360 is used as a drive source that drives the change mechanism 300. The change mechanism 300 will be discussed in detail later.

Figure 2:
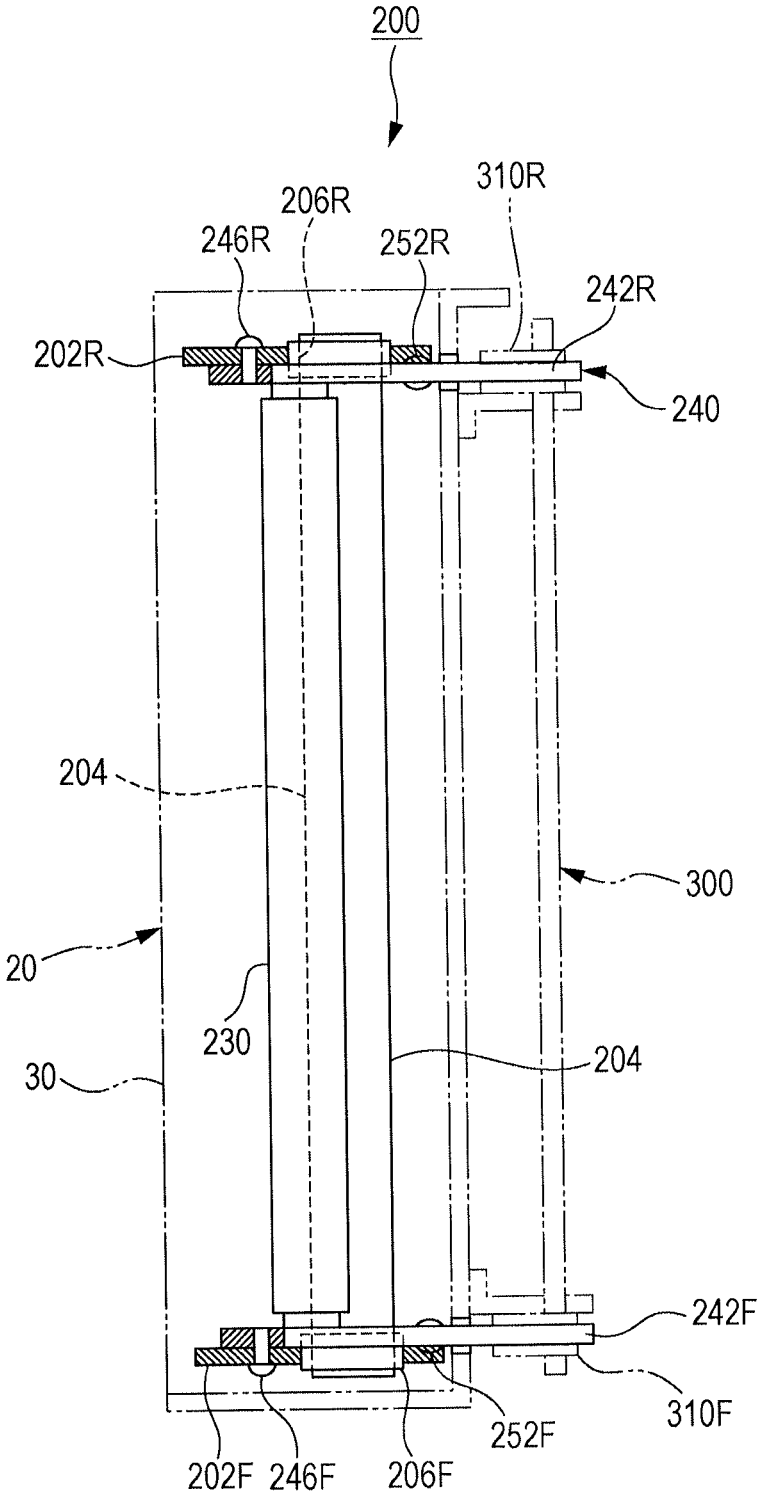
FIG. 2 is a plan view illustrating a fixing device according to the exemplary embodiment of the present invention of the image forming apparatus illustrated in FIG. 1.
Figure 3:
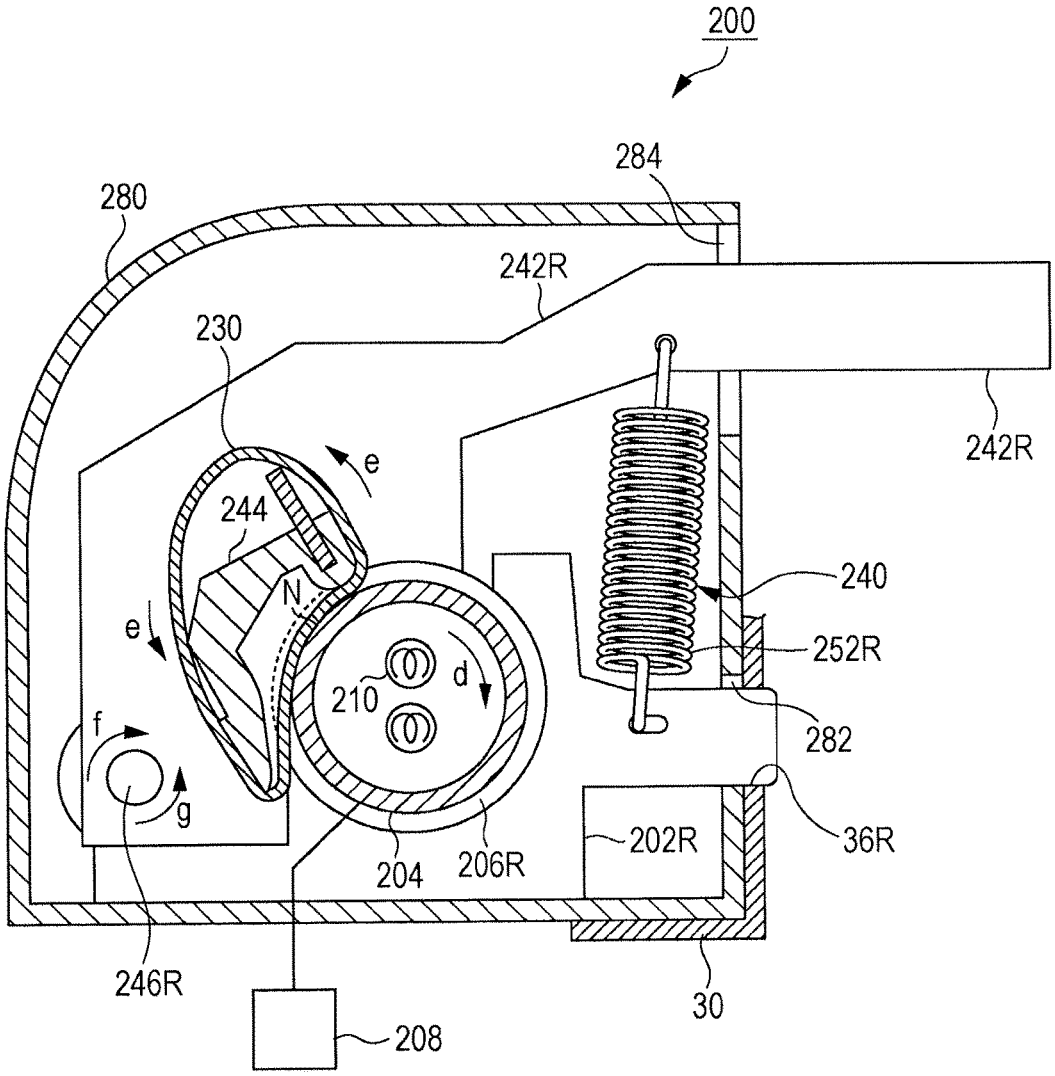
FIG. 3 is a vertical sectional view illustrating the fixing device illustrated in FIG. 2.

The fixing device 200 is illustrated in FIGS. 2 and 3. In FIG. 2, in order to illustrate the internal configuration of the fixing device 200, a fixing device body 280 to be discussed later is not illustrated. As illustrated in FIGS. 2 and 3, the fixing device 200 includes the fixing device body 280, and further includes a rear side plate 202R which is a side plate positioned on the rear side (the upper side in FIG. 2 and the back side with respect to the sheet surface of FIG. 3) in the fixing device body 280, and a front side plate 202F which is a side plate positioned on the front side (the lower side in FIG. 2 and the front side with respect to the sheet surface of FIG. 3) in the fixing device body 280.

The right end portion of the rear side plate 202R passes through a through hole 282 formed in the fixing device body 280 to project rightward from the fixing device body 280. As with the right end portion of the rear side plate 202R, the right end portion of the front side plate 202F also passes through a through hole (not illustrated) formed in the fixing device body 280 to project rightward from the fixing device body 280.

The rear side plate 202R is supported by the tie plate 30 with the fixing device 200 mounted to the image forming apparatus body 20. More specifically, the rear side plate 202R is supported by the tie plate 30 with the right end portion side of the rear side plate 202R inserted into a rear support hole 36R (also see FIG. 5) formed in a tie plate body 32 to be discussed later.

As with the rear side plate 202R, the front side plate 202F is also supported by the tie plate 30 with the fixing device 200 mounted to the image forming apparatus body 20. More specifically, the front side plate 202F is supported by the tie plate 30 with the right end portion side of the front side plate 202F inserted into a front support hole 36F (see FIG. 5) formed in the tie plate body 32 to be discussed later.

The fixing device 200 further includes the fixing roller 204. The fixing roller 204 is used as a first rotator, and contacts the paper etc. on which a developer image has been formed by the image forming portion 100. The fixing roller 204 is supported such that the rear end portion side thereof is rotatable with respect to the rear side plate 202R via a rear bearing 206R. The fixing roller 204 is supported such that the front end portion side thereof is rotatable with respect to the front side plate 202F via a front bearing 206F.

A drive source 208 such as a motor, for example, is coupled to the fixing roller 204. The fixing roller 204 receives a drive force transmitted from the drive source 208 to be rotated in the direction of the arrow d indicated in FIG. 3. The fixing roller 204 has a cylindrical shape. A heat source 210 is disposed in a hollow portion of the fixing roller 204. A halogen lamp or the like may be used as the heat source 210.

The fixing device 200 further includes the fixing belt 230. The fixing belt 230 is used as a second rotator, and contacts the fixing roller 204 to form an interposition region N in which paper is interposed between the fixing roller 204 and the fixing belt 230. The fixing belt 230 is a flexible endless belt-like member, and is rotatably supported by a belt support portion 244 disposed inside the fixing belt 230. The fixing belt 230 is driven by rotation of the fixing roller 204 in the direction of the arrow d to be rotated in the direction of the arrow e.

The belt support portion 244 is positioned inside the fixing belt 230, and supports the fixing belt 230. The rear end portion of the belt support portion 244 is fixed to a rear lever member 242R to be discussed later. The front end portion of the belt support portion 244 is fixed to a front lever member 242F to be discussed later.

The fixing device 200 further includes a pressing mechanism 240 that presses the fixing roller 204 and the fixing belt 230 against each other. The pressing mechanism 240 includes the belt support portion 244 discussed earlier, and further includes the rear lever member 242R and the front lever member 242F. The rear lever member 242R and the front lever member 242F are each used as a movable member, and are each movable in the direction in which the fixing roller 204 and the fixing belt 230 are relatively moved closer to each other (at least one of the fixing roller 204 and the fixing belt 230 is moved closer to the other) and the direction in which the fixing roller 204 and the fixing belt 230 are relatively moved away from each other (at least one of the fixing roller 204 and the fixing belt 230 is moved away from the other).

That is, the rear lever member 242R is supported by a rear shaft member 246R so as to be rotatable with respect to the rear side plate 202R. The front lever member 242F is supported by a front shaft member 246F so as to be rotatable with respect to the front side plate 202F. The belt support portion 244, the fixing belt 230, the rear lever member 242R, and the front lever member 242F are moved so as to be rotated together about the rear shaft member 246R and the front shaft member 246F so that the rear lever member 242R and the front lever member 242F are each moved in the direction in which the fixing roller 204 and the fixing belt 230 are relatively moved closer to each other and the direction in which the fixing roller 204 and the fixing belt 230 are relatively moved away from each other.

The arrow f indicated in FIG. 3 indicates the direction of movement of the rear lever member 242R and the front lever member 242F in which the fixing roller 204 and the fixing belt 230 are relatively moved closer to each other. The arrow g indicated in FIG. 3 indicates the direction of movement of the rear lever member 242R and the front lever member 242F in which the fixing roller 204 and the fixing belt 230 are relatively moved away from each other.

The right side portion of the rear lever member 242R passes through a through hole 284 formed in the fixing device body 280 to project rightward from the fixing device body 280. As with the right end portion of the rear lever member 242R, the right side portion of the front lever member 242F also passes through a through hole (not illustrated) formed in the fixing device body 280 to project rightward from the fixing device body 280.

The pressing mechanism 240 further includes a rear coil spring 252R and a front coil spring 252F. The rear coil spring 252R and the front coil spring 252F are each used as an urging member, and urge the rear lever member 242R and the front lever member 242F in the direction in which the fixing roller 204 and the fixing belt 230 are relatively moved closer to each other, that is, in the direction of the arrow f.

One end portion side of the rear coil spring 252R is mounted to the rear lever member 242R. The other end portion side of the rear coil spring 252R is supported by the rear side plate 202R. One end portion side of the front coil spring 252F is mounted to the front lever member 242F. The other end portion side of the front coil spring 252F is supported by the front side plate 202F. In this way, the rear side plate 202R is used as a first support portion that supports the other end portion side of the rear coil spring 252R which is used as an urging member, and the front side plate 202F is used as a first support portion that supports the other end portion side of the front coil spring 252F which is used as an urging member.

In FIG. 2 which is a plan view illustrating the fixing device 200, in order to illustrate the positional relationship between the fixing device 200 and the other members with the fixing device 200 mounted to the image forming apparatus body 20 (see FIG. 1), a rear cam member 310R to be discussed later which is a member of the change mechanism 300, a front cam member 310F to be discussed later which is also a member of the change mechanism 300, and the tie plate 30 are illustrated by the phantom lines (double-dashed lines).

Figure 4:
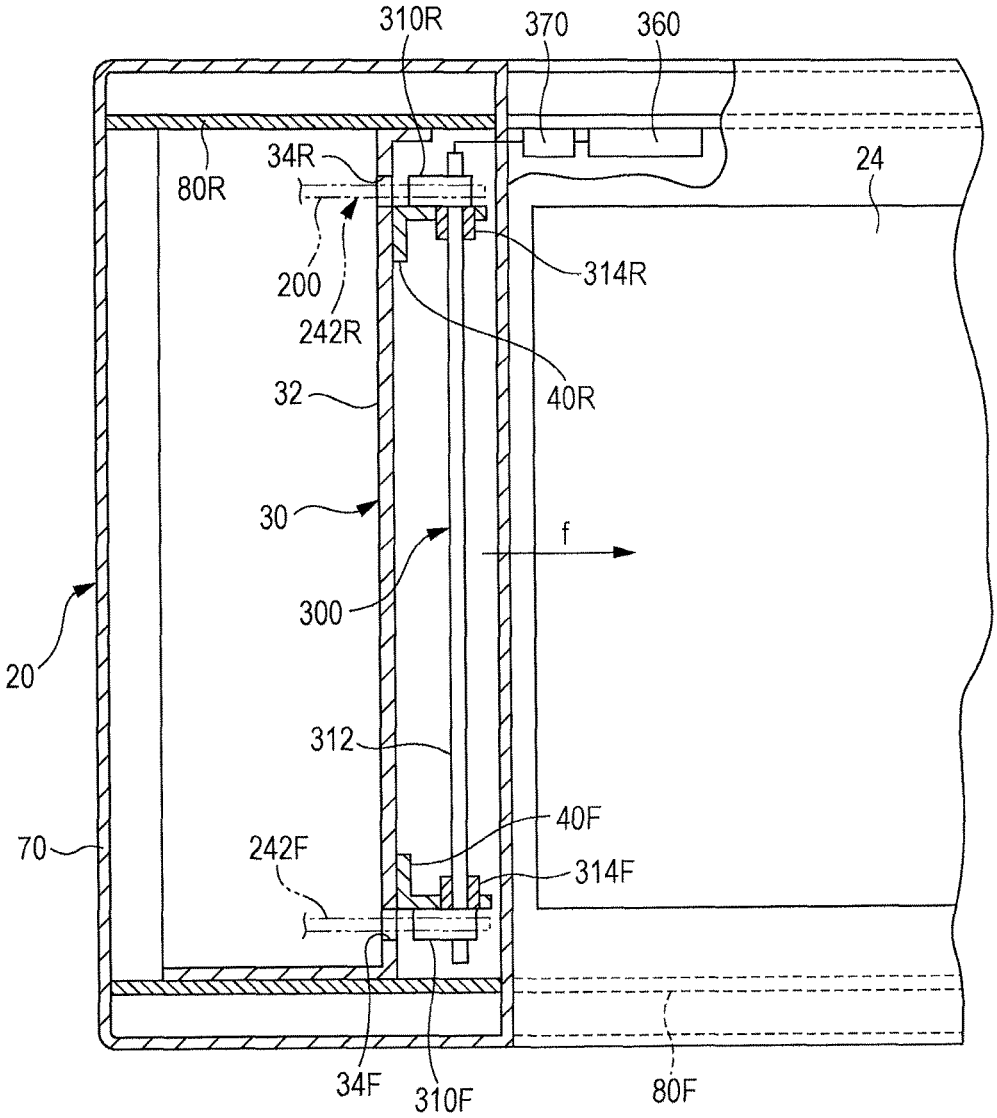
FIG. 4 illustrates a section of the image forming apparatus illustrated in FIG. 1 taken along the line IV-IV of FIG. 1.

FIG. 4 illustrates a section of the image forming apparatus 10 taken along the line IV-IV of FIG. 1 with the fixing device 200 detached from the image forming apparatus body 20. In FIG. 4, in order to illustrate the positional relationship between the change mechanism 300 and the fixing device 200, a part of the fixing device 200 is illustrated by the phantom lines (double-dashed lines).

As illustrated in FIG. 4, the image forming apparatus body 20 forms an outer frame of the image forming apparatus 10, and includes an outer covering portion 70 manufactured by shaping a resin or the like, for example. The image forming apparatus body 20 includes a rear frame portion 80R and a front frame portion 80F. The rear frame portion 80R is disposed on the rear side in a space surrounded by the outer covering portion 70, and made of metal, for example. The front frame portion 80F is disposed on the front side in the space surrounded by the outer covering portion 70, and made of metal, for example. The tie plate 30 discussed earlier is fixed to the rear frame portion 80R and the front frame portion 80F to be supported by the rear frame portion 80R and the front frame portion 80F.

As illustrated in FIG. 4, the change mechanism 300 includes the rear cam member 310R (also see FIG. 6) and the front cam member 310F. The rear cam member 310R is positioned on the rear side in the image forming apparatus body 20. The front cam member 310F is positioned on the front side in the image forming apparatus body 20. The rear cam member 310R and the front cam member 310F are each used as a cam member that moves the rear lever member 242R and the front lever member 242F in the direction in which the fixing roller 204 and the fixing belt 230 are relatively moved away from each other against the urging by the rear coil spring 252R and the front coil spring 252F.

The change mechanism 300 further includes a coupling shaft 312. The rear cam member 310R and the front cam member 310F are mounted to the coupling shaft 312. The coupling shaft 312 is used as a shaft member.

Figure 6:
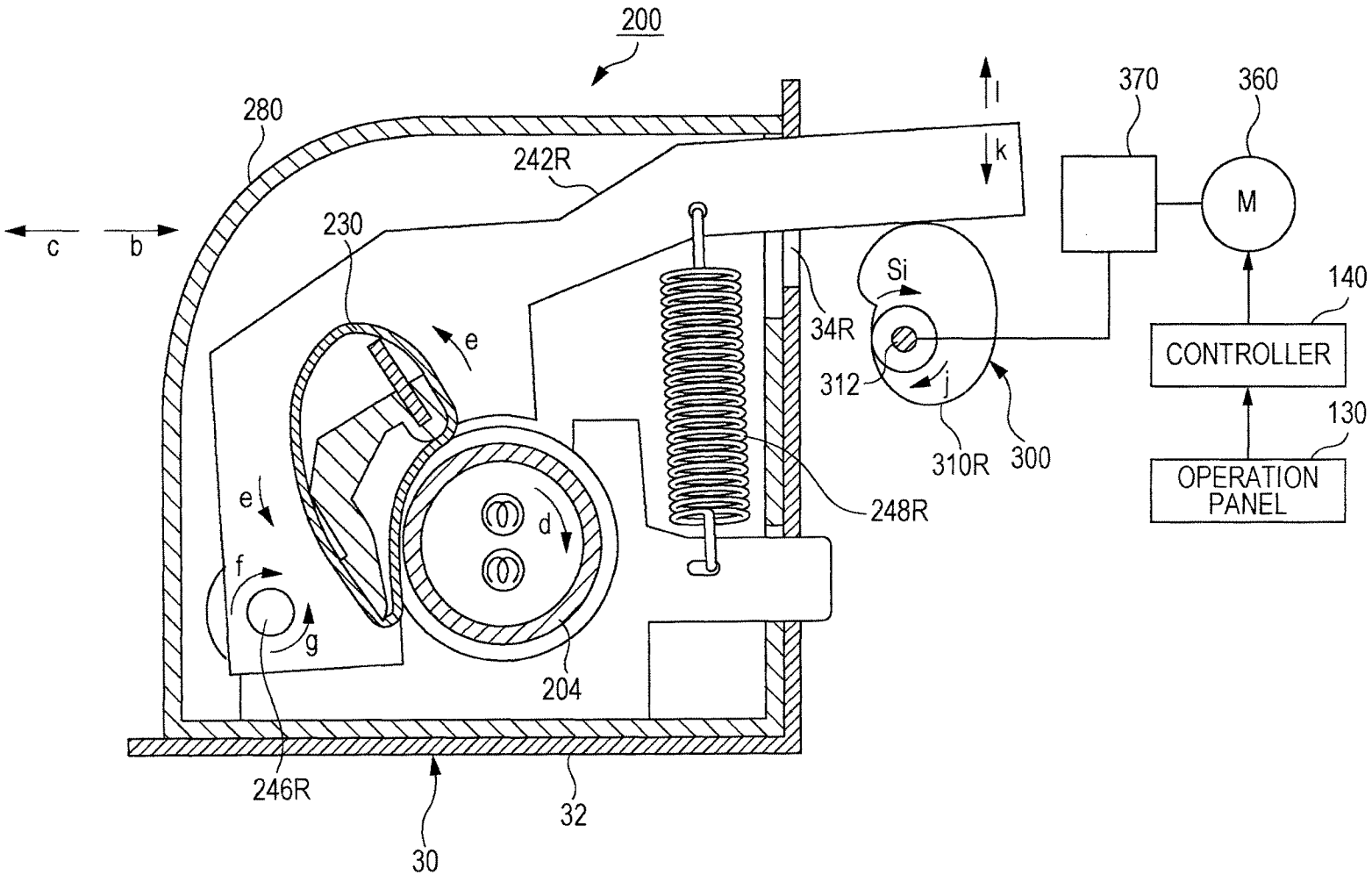
FIG. 6 illustrates components that drive a cam member of the image forming apparatus illustrated in FIG. 1 and operation of the cam member.

The position at which the rear cam member 310R is fixed to the coupling shaft 312 is determined such that the rear cam member 310R and the rear lever member 242R may contact each other (also see FIG. 6). The position at which the front cam member 310F is fixed to the coupling shaft 312 is determined such that the front cam member 310F and the front lever member 242F may contact each other.

The coupling shaft 312 is rotatably supported by a rear support plate 40R mounted to the tie plate body 32 to form a part of the tie plate 30 and a front support plate 40F also mounted to the tie plate body 32 to form a part of the tie plate 30. More specifically, the coupling shaft 312 is supported such that the rear end portion side thereof is mounted to the rear support plate 40R using a rear bearing 314R and the front end portion side thereof is mounted to the front support plate 40F using a front bearing 314F.

As illustrated in FIG. 4, the change mechanism 300 is disposed between the tie plate 30 and the ejection portion 24 in the direction indicated by the arrow f in FIG. 4 in which the paper is ejected to the ejection portion 24. As illustrated in FIG. 4, the rear cam member 310R and the front cam member 310F are disposed on the outer side with respect to the ejection portion 24 in the direction of the width of the ejection portion 24 which crosses the direction indicated by the arrow f in which the paper is ejected to the ejection portion 24.

The motor 360 is attached to the rear frame portion 80R of the image forming apparatus body 20. The motor 360 is coupled to the coupling shaft 312 via a drive transmission mechanism 370 such as a gear train, for example. The motor 360 transmits a drive force to rotate the rear cam member 310R, the front cam member 310F, and the coupling shaft 312 together with respect to the image forming apparatus body 20.

As with the motor 360, the drive transmission mechanism 370 is attached to the rear frame portion 80R. Although the drive transmission mechanism 370 is composed of a gear train etc. as discussed earlier, the drive transmission mechanism 370 is illustrated schematically in FIG. 4 with gears etc. composing the gear train discussed above not illustrated.

Figure 5:
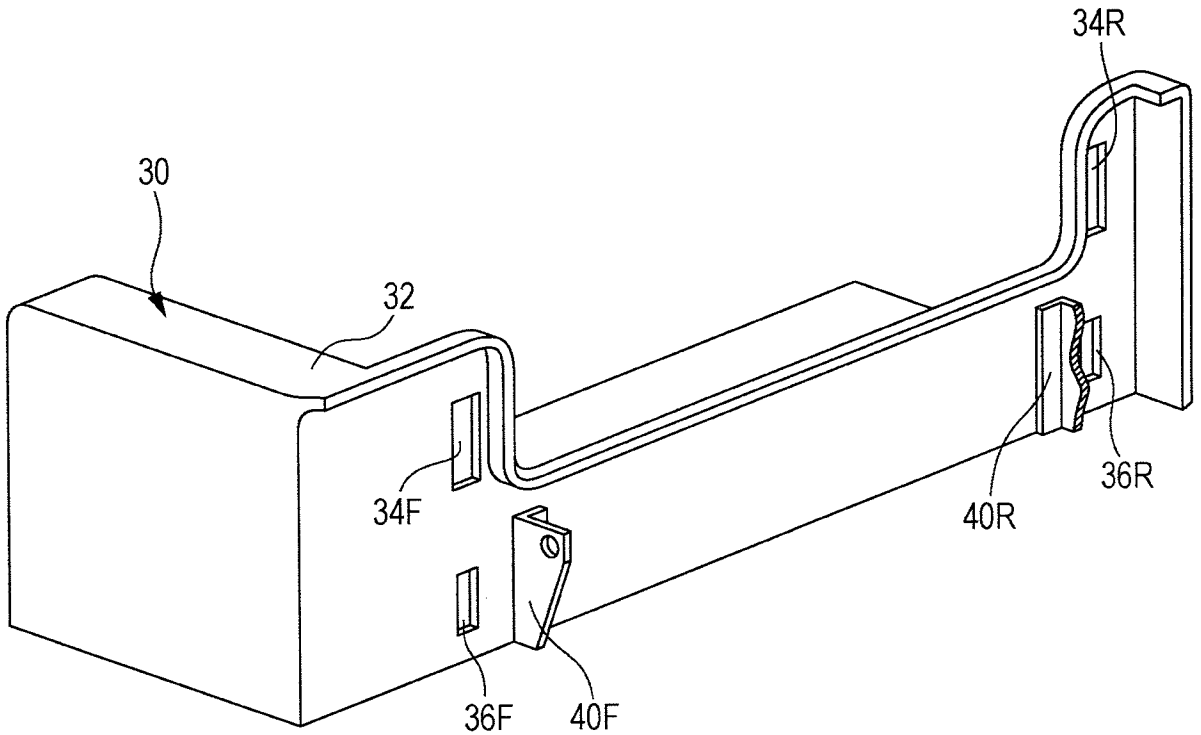
FIG. 5 is a perspective view illustrating a tie plate of the image forming apparatus illustrated in FIG. 1.

The tie plate body 32 includes a rear opening portion 34R formed at a position on the rear side and a front opening portion 34F formed at a position on the front side (also see FIG. 5). The rear lever member 242R passes through the rear opening portion 34R to project from the side of the fixing device 200 with respect to the tie plate 30 to the side of the change mechanism 300 with respect to the tie plate 30. The front lever member 242F passes through the front opening portion 34F to project from the side of the fixing device 200 with respect to the tie plate 30 to the side of the change mechanism 300 with respect to the tie plate 30.

FIG. 5 illustrates the tie plate 30. The tie plate 30 includes the tie plate body 32 as discussed earlier. The rear support plate 40R discussed earlier is fixed to the rear side of the tie plate body 32. The front support plate 40F discussed earlier is fixed to the front side of the tie plate body 32. The tie plate body 32 includes the rear opening portion 34R discussed earlier formed on the rear side and the front opening portion 34F discussed earlier formed on the front side.

The tie plate body 32 also includes the rear support hole 36R formed at a position on the rear side and on the lower side of the rear opening portion 34R, for example. The tie plate body 32 also includes the front support hole 36F formed at a position on the front side and on the lower side of the front opening portion 34F, for example.

FIG. 6 illustrates the configuration and operation of the change mechanism 300. The change mechanism 300 operates with the motor 360 controlled by a controller 140, for example, on the basis of an input from the operation panel 130, for example.

The controller 140 includes a control circuit including a central processing unit (CPU), for example, and determines a fixing condition on the basis of whether the paper feed device selected by the input to the operation panel 130 is the paper feed device 610 or the paper feed device 620, and controls the motor 360 on the basis of the determined fixing condition. That is, in the case where the paper feed device 610 is selected, the motor 360 is controlled so as to achieve a fixing condition that is suitable for the paper accommodated in the paper feed device 610. In the case where the paper feed device 620 is selected, the motor 360 is controlled so as to achieve a fixing condition that is suitable for the paper accommodated in the paper feed device 620.

The motor 360 is rotated on the basis of the control by the controller 140 to rotate the rear cam member 310R and the front cam member 310F (see FIG. 2) in the direction of the arrow i or the direction of the arrow j indicated in FIG. 6. When the rear cam member 310R and the front cam member 310F are rotated, the right end side of the rear lever member 242R and the front lever member 242F (see FIG. 2) is moved in the direction of the arrow k indicated in FIG. 6 or the direction of the arrow l indicated in FIG. 6.

Instead of the motor 360 rotating the rear cam member 310R and the front cam member 310F in the direction of the arrow i or the direction of the arrow j indicated in FIG. 6, the motor 360 may rotate the rear cam member 310R and the front cam member 310F only in the direction of the arrow i or the direction of the arrow j indicated in FIG. 6.

The direction of the arrow k and the direction of the arrow l, in which the right end portion side of the rear lever member 242R and the right end portion side of the front lever member 242F are moved, cross the direction of the arrow b and the direction of the arrow c (also see FIG. 1), in which the fixing device 200 is mounted to and removed from the image forming apparatus body 20.

Figure 7A:
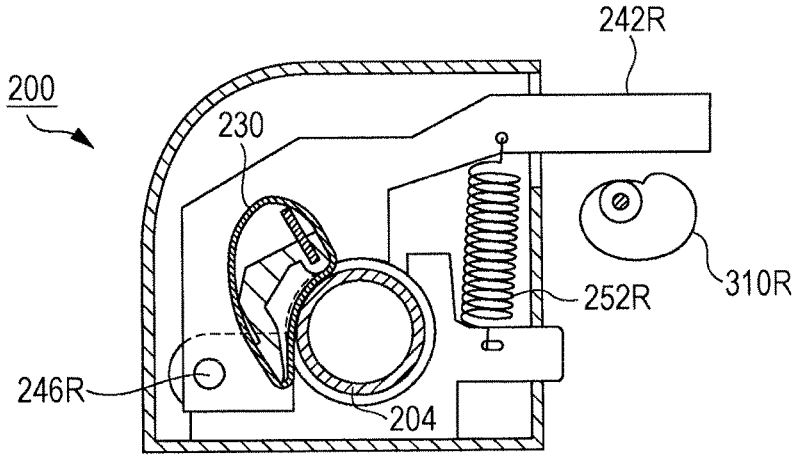
FIG. 7A illustrates operation of the image forming apparatus illustrated in FIG. 1, illustrating a state of the fixing device at the time when a developer image is fixed to regular paper.
Figure 7B:
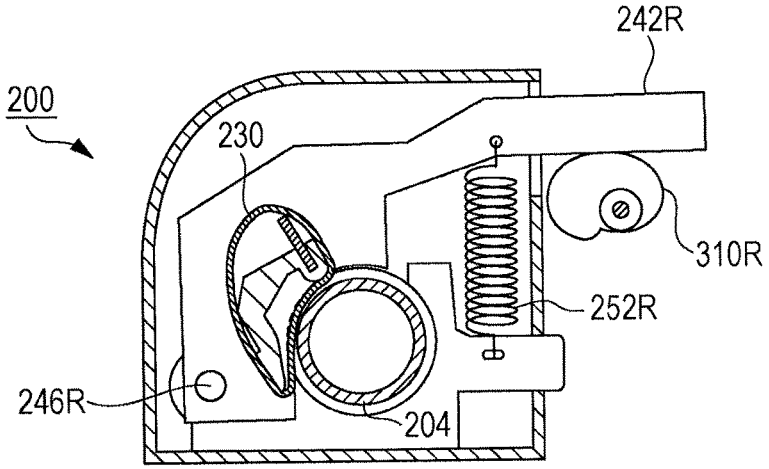
FIG. 7B illustrates operation of the image forming apparatus illustrated in FIG. 1, illustrating a state of the fixing device at the time when a developer image is fixed to an envelope.
Figure 7C:
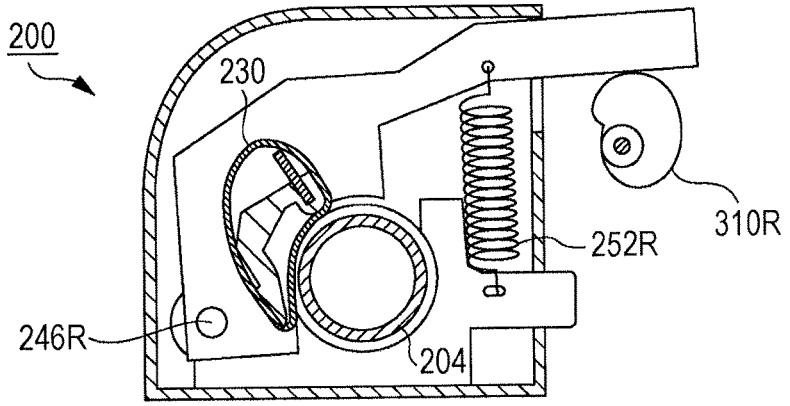
FIG. 7C illustrates operation of the image forming apparatus illustrated in FIG. 1, illustrating a state of the fixing device in which a force of pressing a first rotator and a second rotator against each other has been canceled.

FIGS. 7A to 7C further illustrate operation of the change mechanism 300. FIG. 7A illustrates a state of the fixing device 200 at the time when a developer image is fixed to regular paper. FIG. 7B illustrates a state of the fixing device 200 at the time when a developer image is fixed to an envelope. FIG. 7C illustrates a state of the fixing device 200 in which a force of pressing the fixing roller 204 and the fixing belt 230 against each other has been canceled.

As illustrated in FIGS. 7A to 7C, the position of the rear lever member 242R is different among the state illustrated in FIG. 7A, the state illustrated in FIG. 7B, and the state illustrated in FIG. 7C. The rear lever member 242R is moved by the action of the rear cam member 310R which receives a drive force transmitted from the motor 360 as discussed earlier to be rotated. Although the front lever member 242F is not illustrated in FIGS. 7A to 7C, the front lever member 242F is moved in the same manner as the rear lever member 242R together with the rear lever member 242R.

In the state illustrated in FIG. 7A, the rear cam member 310R is not in contact with the rear lever member 242R. The fixing belt 230 is pressed against the fixing roller 204 by the action of the rear coil spring 252R and the front coil spring 252F (not illustrated).

In the state illustrated in FIG. 7B, the rear lever member 242R has been moved in the direction of the arrow g and the arrow l from the position illustrated in FIG. 7A by the action of the rear cam member 310R, and the front lever member 242F has been moved in the same manner as the rear lever member 242R. In the state illustrated in FIG. 7B, the force with which the rear coil spring 252R presses the fixing belt 230 against the fixing roller 204 has been weakened compared to the state illustrated in FIG. 7A. Similarly, the force with which the front coil spring 252F presses the fixing belt 230 against the fixing roller 204 has been weakened compared to the state illustrated in FIG. 7A.

In the state illustrated in FIG. 7C, the rear lever member 242R has been further moved in the direction of the arrow g and the arrow l from the position illustrated in FIG. 7B by the action of the rear cam member 310R, and the front lever member 242F has been moved in the same manner as the rear lever member 242R. In the state illustrated in FIG. 7C, the force with which the rear coil spring 252R and the front coil spring 252F press the fixing belt 230 against the fixing roller 204 has been canceled. In FIG. 7C, for convenience of illustration, the fixing belt 230 and the fixing roller 204 are illustrated as contacting each other. However, it is desirable that the fixing roller 204 and the fixing belt 230 should not contact each other in a state in which a force of pressing the fixing roller 204 and the fixing belt 230 against each other has been canceled.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming portion that forms a developer image on a recording medium; and a fixing device that is removably mounted to an image forming apparatus body and that fixes the developer image formed by the image forming portion to the recording medium, wherein the fixing device includes a first rotator that contacts the recording medium on which the developer image has been formed by the image forming portion, a second rotator that contacts the first rotator to form an interposition region in which the recording medium is interposed between the first rotator and the second rotator, a movable member that is movable in a direction in which at least one of the first rotator and the second rotator is moved such that a distance between the first rotator and the second rotator becomes shorter and a direction in which at least one of the first rotator and the second rotator is moved such that the distance between the first rotator and the second rotator becomes longer, an urging member, a first end portion side of which is mounted to the movable member, the urging member urging the movable member to move the movable member in the direction in which the first rotator and the second rotator are moved closer to each other, and a first support portion that supports a second end portion side of the urging member, and the image forming apparatus further includes a cam member that moves the movable member in the direction in which the first rotator and the second rotator are moved away from each other against the urging by the urging member, a shaft member to which the cam member is mounted, and a second support portion that supports the shaft member and the first support portion.

2. The image forming apparatus according to claim 1, wherein the second support portion comprises a part of the image forming apparatus body.

3. The image forming apparatus according to claim 2, wherein the second support portion is formed from a fixed portion to which the fixing device is fixed.

4. The image forming apparatus according to claim 1, wherein the movable member passes through an opening portion formed in the second support portion to project from a side of the fixing device with respect to the second support portion to a side opposite to the fixing device with respect to the second support portion.

5. The image forming apparatus according to claim 1, wherein the movable member is movable in a direction that crosses a direction in which the fixing device is mounted to and removed from the image forming apparatus body.

6. The image forming apparatus according to claim 1, further comprising:

a drive source that drives the cam member, wherein the drive source is mounted to the image forming apparatus body.

7. A fixing device removably mounted to an image forming apparatus body, the fixing device comprising:

a first rotator that contacts a recording medium on which a developer image has been formed by an image forming portion;

a second rotator that contacts the first rotator to form an interposition region in which the recording medium is interposed between the first rotator and the second rotator;

a movable member that is movable in a direction in which at least one of the first rotator and the second rotator is moved such that a distance between the first rotator and the second rotator becomes shorter and a direction in which at least one of the first rotator and the second rotator is moved such that the distance between the first rotator and the second rotator becomes longer;

an urging member, a first end portion side of which is mounted to the movable member, the urging member urging the movable member to move the movable member in the direction in which the first rotator and the second rotator are moved closer to each other; and a first support portion that supports a second end portion side of the urging member, wherein the movable member is moved by a cam member mounted to a shaft member in the direction in which the first rotator and the second rotator are moved away from each other against the urging by the urging member, and the first support portion is supported by a second support portion that supports the shaft member.

* * * * *